US011713152B2

(12) United States Patent
Waegele et al.

(10) Patent No.: US 11,713,152 B2
(45) Date of Patent: Aug. 1, 2023

(54) WORK STATION FOR A PACKAGING MACHINE WITH A LIFTING MECHANISM WITH A TOGGLE LEVER MECHANISM

(71) Applicant: MULTIVAC SEPP HAGGENMUELLER SE & CO. KG, Wolfertschwenden (DE)

(72) Inventors: Markus Waegele, Lautrach (DE); Florian Lutz, Ottobeuren (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 75 days.

(21) Appl. No.: 17/124,376

(22) Filed: Dec. 16, 2020

(65) Prior Publication Data

US 2021/0179307 A1 Jun. 17, 2021

(30) Foreign Application Priority Data

Dec. 17, 2019 (DE) ..... 102019219833.3

(51) Int. Cl.
*B65B 65/02* (2006.01)
*B65B 9/04* (2006.01)
(Continued)

(52) U.S. Cl.
CPC ..... *B65B 65/02* (2013.01); *B65B 9/04* (2013.01); *B65B 47/04* (2013.01); *B65B 61/06* (2013.01)

(58) Field of Classification Search
USPC ..... 53/453
See application file for complete search history.

(56) References Cited

U.S. PATENT DOCUMENTS 3,552,093 A * 1/1971 Heiser et al. ..... B65B 51/14 53/374.8
5,819,510 A * 10/1998 Bochtler ..... B65B 9/04 53/559
(Continued)

FOREIGN PATENT DOCUMENTS

DE 42 16 210 A1 11/1993
DE 10 2006 050 415 A1 4/2008
(Continued)

OTHER PUBLICATIONS

German Search Report dated Dec. 17, 2019, Application No. 10 2019 219 833.3, Applicant MULTIVAC SEPP Haggenmueller SE & Co. KG. 5 Pages.
(Continued)

*Primary Examiner* — Chinyere J Rushing-Tucker
(74) *Attorney, Agent, or Firm* — Brooks Kushman P.C.

(57) ABSTRACT

The work station for a packaging machine comprises an upper tool, a lower tool, and a lifting mechanism. The lower tool is guided for a closing motion directed along a vertical direction towards the upper tool. The lifting mechanism comprises a toggle lever mechanism which connects the lower tool to a support structure. The lifting mechanism comprises a first actuator assembly and a second actuator assembly. The first actuator assembly is configured to apply a first force for raising the lower tool. The second actuator assembly is configured to apply a second force for raising the lower tool. The first actuator assembly acts upon the lower tool while bypassing the toggle lever mechanism. The second actuator assembly acts upon the toggle lever mechanism.

23 Claims, 3 Drawing Sheets

(51) Int. Cl.
*B65B 47/04* (2006.01)
*B65B 61/06* (2006.01)

(56) References Cited

U.S. PATENT DOCUMENTS

| | | | | |
|---|---|---|---|---|
| 6,006,505 | A | 12/1999 | Natterer | |
| 2010/0011718 | A1 | 1/2010 | Donges et al. | |
| 2021/0300615 | A1 * | 9/2021 | Mayer | B65B 65/00 |

FOREIGN PATENT DOCUMENTS

| | | | |
|---|---|---|---|
| DE | 10 2009 008 452 | B3 | 10/2010 |
| DE | 10 2009 017 871 | A1 | 10/2010 |
| DE | 103 51 567 | B4 | 6/2017 |
| EP | 0 895 933 | A1 | 2/1992 |
| EP | 0 569 937 | A1 | 11/1993 |
| WO | 2005/075291 | A2 | 8/2005 |

OTHER PUBLICATIONS

European Communication with Search Report (with English Machine Translation) dated May 11, 2021, Application No. 20210091.3-1016, Applicant MULTIVAC Sepp Haggenmueller SE & Co. KG, 12 Pages.
EP Communication with Search Report Application No. 20210091.3-1016 dated May 11, 2021, English Machine Translation.
EP 0 569 937 A1, Abstract & Machine Translation.
WO 2005/075291 A2, Abstract & Machine Translation.

* cited by examiner

WORK STATION FOR A PACKAGING MACHINE WITH A LIFTING MECHANISM WITH A TOGGLE LEVER MECHANISM

CROSS-REFERENCE TO RELATED APPLICATIONS

This application claims foreign priority benefits under 35 U.S.C. § 119(a)-(d) to German patent application number DE 10 2019 219 833.3, filed Dec. 17, 2019, which is incorporated by reference in its entirety.

TECHNICAL FIELD

The present disclosure relates to work stations for packaging machines with a lifting mechanism for raising a lower tool.

BACKGROUND

A packaging machine configured as a thermoformer is known from DE 103 51 567 B4 in which at least one tool can be moved to a lowered and to a raised position with a toggle lever. The tool has an electric linear drive as a drive which drives the toggle lever.

DE 42 16 210 A1 describes a packaging machine with a deep-drawing station comprising an upper part and a lower part that can be lowered relative to the former to a lowered position or raised to a raised position, respectively. For moving the lower part, a lifting device is provided which comprises a toggle lever system. The toggle lever system is operated by way of a piston-cylinder device.

DE 10 2009 008 452 B3 describes a deep-drawing packaging machine with a work station which comprises a stationary tool half and a movable tool half. The stationary tool half is attached to the upper ends of guide struts. The movable tool half can be moved along the guide struts by way of guide bushings and can therefore be moved towards and away from the stationary tool half. The movable tool half is moved towards and away from the stationary tool half using an electric lifting mechanism. The electric lifting mechanism consists of a first lifting device for causing a raising motion with a large stroke and a second lifting device for causing a raising motion with a small stroke. The second lifting device generates a force which presses the movable tool half against the stationary tool half. The first lifting device consists of a first electric motor and a toggle lever linkage. The first lifting device causes a large stroke of the movable tool half which has been reached once a dead center of the toggle lever linkage has been reached. The second lifting device comprises an electric motor and an eccentric shaft which connects a first lever of the toggle lever linkage to a second lever of the toggle lever linkage. When the output shaft of the second electric motor is rotated, the second lever of the toggle lever linkage is raised or lowered relative to the first lever of the toggle lever linkage, whereby a stroke of the second lever is generated.

There is a need for a lifting mechanism for raising a lower tool of a work station of a packaging machine having good power transmission. There is a need for a lifting mechanism for raising a lower tool of a work station of a packaging machine that can be produced inexpensively. There is a need for a lifting mechanism for raising a lower tool of a work station of a packaging machine having good stability.

SUMMARY

The disclosure relates to a work station for a packaging machine and a method for operating a work station for a packaging machine. The dependent claims indicate advantageous embodiments of the disclosure.

A work station according to the disclosure for a packaging machine comprises an upper tool, a lower tool, and a lifting mechanism. The lower tool is guided for a closing motion that is directed along a vertical direction towards the upper tool. The lifting mechanism comprises a toggle lever mechanism which connects the lower tool to a support structure. The lifting mechanism comprises a first actuator assembly and a second actuator assembly. The first actuator assembly is configured to apply a first force for raising the lower tool. The second actuator assembly is configured to apply a second force for raising the lower tool. The first actuator assembly acts upon the lower tool, while bypassing the toggle lever mechanism. The second actuator assembly acts upon the toggle lever mechanism.

Within the context of the disclosure, forces that actually lead to the lower tool being raised as well as forces that act upon the lower tool upwardly, but do not lead to an actual motion of the lower tool, are forces "for raising the lower tool". In particular, a contact pressure with which the lower tool is pressed against the upper tool from below is a "force for raising the lower tool" in the sense of the disclosure or part of such a force.

As two actuator assemblies are provided for applying forces for raising the lower tool, the individual actuator assemblies can be dimensioned smaller than if only a single actuator assembly were provided. Suitable adaptation of the lifting forces acting upon the lower tool in dependence of the operating situation of the work station is facilitated. For example, in certain operating states, only one of the two actuator assemblies may be active for exerting a force upon the lower tool, while the other actuator assembly is inactive. In operating states in which increased force is required to raise the lower tool, in particular when the lower tool is to be pressed against the upper tool, both actuator assemblies may be active.

A toggle lever mechanism has the property that the transmission ratio between the force applied and the resulting force shifts continuously during the motion of the toggle lever mechanism. The toggle lever mechanism therefore has ranges of motion in which it provides a transmission ratio that is favorable for transmission of a large force, but also ranges of motion in which the transmission ratio is unfavorable for the transmission of a large force. As the first actuator assembly acts upon the lower tool while bypassing the toggle lever mechanism, the effect of the first force applied by the first actuator assembly upon the lower tool is independent of the current operating state of the toggle lever mechanism. This may ensure that the lower tool may be raised efficiently even when the toggle lever mechanism is in a state in which it has a transmission ratio that is unfavorable for good transmission of force. The second actuator assembly acts upon the toggle lever mechanism and allows the leverage provided by the toggle lever mechanism to be used to raise the lower tool.

The first actuator assembly may act directly upon the lower tool. The first actuator assembly may act upon an element rigidly connected to the lower tool. The first actuator assembly may act upon an element which carries the lower tool without there being an articulate connection between the lower tool and the element upon which the first actuator assembly acts. The first actuator assembly may act upon the lower tool without the involvement of an articulate connection. It is also conceivable that there is, for example, at most one articulate connection between the lower tool and the actuator assembly.

The lower tool may be raised relative to the support structure by way of the first force. The lower tool may be raised relative to the upper tool by way of the first force. The lower tool may be raised relative to the support structure by way of the second force. The lower tool may be raised relative to the upper tool by way of the second force.

The upper tool may be attached in a stationary manner to a frame of the work station. The support structure may be attached in a stationary manner to a frame of the work station or it may be part of the frame of the work station. The support structure may be stationary with respect to the upper tool.

The first actuator assembly may be configured to raise the lower tool by a first stroke. The second actuator assembly may be configured to raise the lower tool by a second stroke. The first stroke may be larger than the second stroke. The first actuator assembly may be optimized for providing a large stroke and the second actuator assembly may be optimized for providing a large force for raising the lower tool. The larger first stroke of the first actuator assembly may make it possible that the lower tool is already moved relatively close to the upper tool by the first actuator assembly.

The second actuator assembly may be configured to be activated to apply the second force after the lower tool has been raised by the first actuator assembly. By switching on the second actuator assembly, an increased force can be provided for pressing the lower tool against the upper tool after the lower tool has been raised by the first actuator assembly.

The first actuator assembly and the second actuator assembly may be configured to apply the first force and the second force simultaneously, at least temporarily. As a result, a particularly high force may be made available temporarily for raising the lower tool. In particular, a large force for pressing the lower tool against the upper tool may be obtained.

The first actuator assembly raising the lower tool preferably leads to an adjustment of the toggle lever mechanism even without active operation of the second actuator assembly. If the toggle lever mechanism is adjusted when the lower tool is raised by the first actuator assembly, the transmission ratio of the toggle lever mechanism changes. The presence of the unfavorable range of the transmission ratio of the toggle lever mechanism does not have a negative effect when the lower tool is raised by the first actuator assembly, since the first actuator assembly acts upon the lower tool while bypassing the toggle lever mechanism. In particular, an unfavorable range of the transmission ratio of the toggle lever mechanism may be overcome while the lower tool is being raised by the first actuator assembly.

The first actuator assembly raising the lifting mechanism preferably leads to an extension of the toggle lever mechanism. When the toggle lever mechanism is extended, the transmission ratio for the second force for raising the lower tool by the second actuator assembly may be increased.

The second actuator assembly may be configured to provide a pressing force for pressing the lower tool against the upper tool.

In principle, it may be sufficient to have the toggle lever mechanism comprise a single toggle lever structure that connects the lower tool to the support structure. However, the toggle lever mechanism preferably comprises multiple toggle lever structures which each connect the lower tool to the support structure. Providing multiple toggle lever structures may ensure improved force absorption by the lower tool. In addition, the provision of multiple toggle lever structures may improve the stability of the lower tool. The second actuator assembly preferably acts upon the multiple toggle lever structures.

The second actuator assembly may comprise an element variable in length. The element variable in length may act simultaneously upon two oppositely disposed toggle lever structures. The element variable in length acting upon two oppositely disposed toggle lever structures achieves an improved introduction of force into the toggle lever structures. The element variable in length may comprise, for example, a pneumatic cylinder, a spindle drive, or an electric linear drive.

The first actuator assembly and/or the second actuator assembly may comprise an element variable in length. This may be, for example, a pneumatic cylinder, a spindle drive, or an electric linear drive.

The lower tool may be suspended on rods. The rods may be, for example, firmly connected to the upper tool. The first actuator assembly may be suspended on the rods. The second actuator assembly may be suspended on the rods.

The second actuator assembly may act upon the toggle lever mechanism in such a way that a transmission ratio of the second force applied by the second actuator assembly—due to the toggle lever mechanism—develops a greater effect for raising the lower tool, the further the toggle lever mechanism is extended.

The disclosure also relates to a method for operating a work station for a packaging machine. The method may be suitable, designed, and/or configured for operating the work station according to the disclosure. Features described with regard to the work station may be transferred to the method and vice versa.

A method according to the disclosure for operating a work station for a packaging machine comprises raising a lower tool along a vertical direction towards an upper tool by applying a first force by way of a first actuator assembly. The first actuator assembly acts upon the lower tool while bypassing a toggle lever mechanism, where the toggle lever mechanism connects the lower tool to a support structure. The method also comprises the application of a second force for pressing the lower tool against the upper tool by way of a second actuator assembly. The second actuator assembly acts upon the toggle lever assembly.

Raising the lower tool by way of the first actuator assembly preferably adjusts the toggle lever assembly.

The toggle lever assembly is preferably first adjusted by raising the lower tool using the first actuator assembly to a working range with improved leverage (improved transmission ratio). The second actuator assembly subsequently actively actuates the toggle lever assembly to further raise the lower tool and/or to press the lower tool against the upper tool.

While the second force is being applied, the first force may also be applied, at least temporarily.

BRIEF DESCRIPTION OF THE DRAWINGS

The disclosure shall be illustrated below in more detail using embodiments, where.

DETAILED DESCRIPTION

Figure 1:
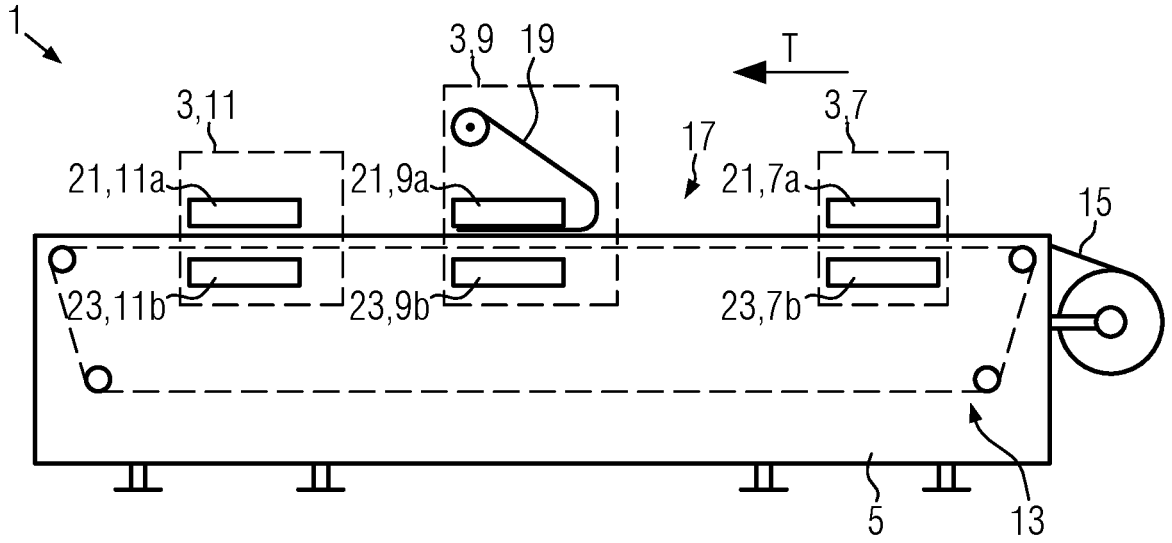
FIG. 1 shows a schematic side view of a packaging machine with a work station according to an embodiment.

FIG. 1 shows an exemplary packaging machine 1 in which a work station 3 according to the disclosure may be employed. In the embodiment shown, packaging machine 1 is configured as a deep-drawing packaging machine. Packaging machine 1 comprises a machine frame 5 on which a forming station 7, a sealing station 9, and a cutting station 11 are arranged. Packaging machine 1 comprises a conveyor device 13 for conveying a base film web 15 along a direction of transport T. Base film web 15 is fed consecutively to forming station 7, to a loading stretch 17 located between forming station 7 and sealing station 9, to sealing station 9, and to cutting station 11.

In forming station 7, packaging trays are formed in base film web 15 by deep drawing. Forming station 7 comprises a forming tool upper part 7*a* and a forming tool lower part 7*b* which is movable relative to the former, both of which interact to deep-draw the packaging trays in base film web 15. The packaging trays formed in base film web 15 are filled in loading stretch 17 with products to be packaged. The filled packagings are closed in sealing station 9 by sealing a top film 19 onto base film 15. Scaling station 9 comprises a sealing tool upper part 9*a* and a sealing tool lower part 9*b* which is movable relative to the former, both of which interact to close the packaging trays with top film 19. The closed packages are separated from the film composite in cutting station 11. Cutting station 11 comprises a cutting tool upper part 11*a* and a cutting tool lower part 11*b* movable relative to the former. Cutting tool upper part 11*a* and cutting tool lower part 11*b* interact to separate the packagings from the film composite.

The disclosure relates to a work station 3 for a packaging machine 1. Work station 3 can be, for example, forming station 7, sealing station 9 or cutting station 11 of a deep-drawing packaging machine. It would also be conceivable, however, that work station 3 is employed in a packaging machine 1 of a different kind, for example, in a tray sealer.

Work station 3 comprises an upper tool 21 and a lower tool 23. Examples of upper tool 21 in packaging machine 1 described above are forming tool upper part 7*a*, sealing tool upper part 9*a*, or cutting tool upper part 11*a*. Examples of lower tool 23 in packaging machine 1 described above are forming tool lower part 7*b*, sealing tool lower part 9*b*, or cutting tool lower part 11*b*.

Figure 2:
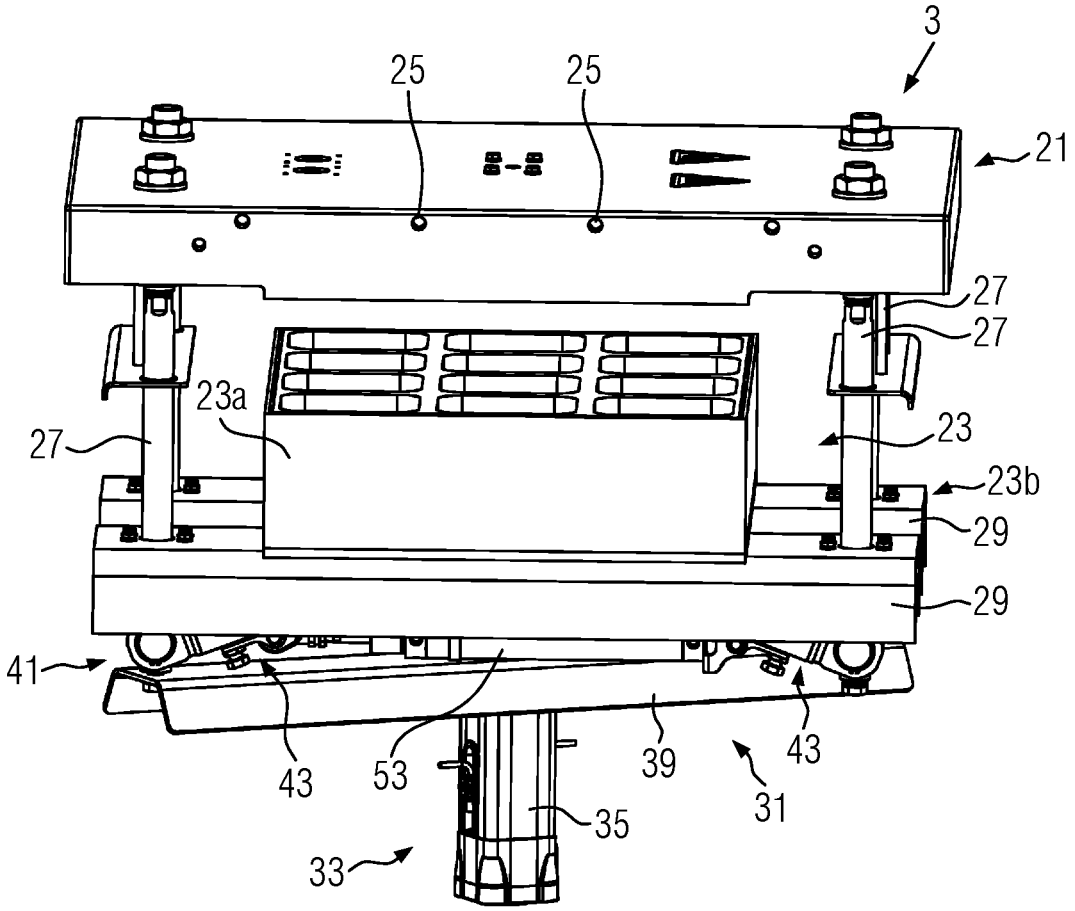
FIG. 2 shows a schematic perspective view of a work station according to an embodiment in the open state of the work station.

FIG. 2 shows a schematic perspective view of a work station 3 according to an embodiment. In the variant shown, the work station is a sealing station 9. The configuration described, however, may also be transferred to other work stations 3 by replacing upper tool 21 and lower tool 23 with differently configured tools.

In the embodiment shown, upper tool 21 is attached to machine frame 5 in a stationary manner. This may be done, for example, using screw holes. Upper tool 21 in FIG. 2 may have coolant bores 25. Vertical rods 27 are attached to upper tool 21. Vertical rods 27 extend downwardly from upper tool 21. Rods 27 provide a vertical guide for lower tool 23. Lower tool 23 is guided along a vertical direction along rods 27 for a motion towards upper tool 21. In the embodiment shown, lower tool 23 comprises a working member 23*a* which interacts with upper tool 21 when lower tool 23 is raised along the vertical direction. In the embodiment shown, working member 23*a* of lower tool 23 comprises recesses for receiving packaging trays, at least in part. In a work cycle, lower tool 23 may first be approached to upper tool 21 along the vertical direction and then pressed thereagainst in order to provide a working pressure. It is understood that, when lower tool 23 is pressed against upper tool 21, one or more components may be present between lower tool 23 and upper tool 21. For example, in the case of a forming station 7, base film web 15 may be present between forming tool lower part 7*b* and forming tool upper part 7*a*, or, in the case of a sealing station 9, base film web 15 and top film 19 may be present between sealing tool lower part 9*b* and sealing tool upper part 9*b*.

In the embodiment shown, lower tool 23 also comprises a support member 23*b* on which working member 23*a* is supported. In the embodiment shown, support member 23*b* of lower tool 23 comprises two parallel, horizontal carrier elements 29. Working member 23*a* of lower tool 23 may simply stand on support member 23*b*. Working member 23*a* may be firmly connected to support member 23*b*, for example, using screw connections. No articulate connection is provided between support member 23*b* and working member 23*a* of lower tool 23.

Figure 3:
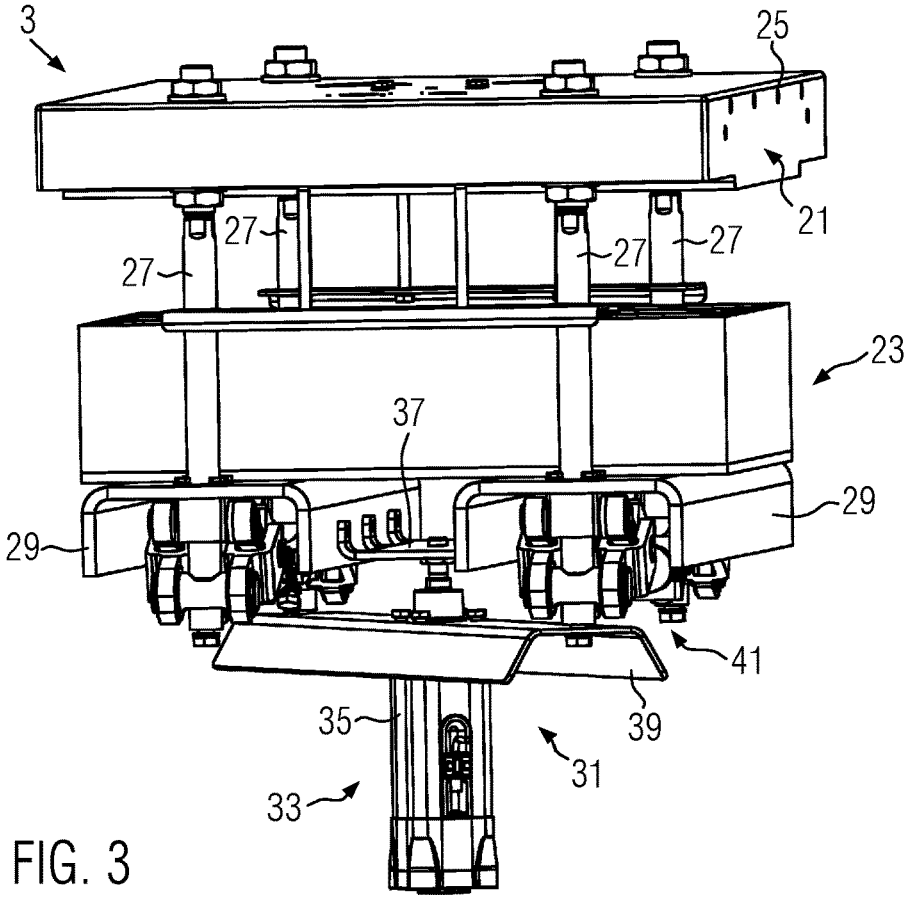
FIG. 3 shows a further schematic perspective view of a work station in the open state of the work station.

Work station 3 comprises a lifting mechanism 31 for raising lower tool 23 and for applying the closing force for pressing lower tool 23 against upper tool 21 As can likely be seen best in FIG. 3, lifting mechanism 31 comprises a first actuator assembly 33 for applying a first force for raising lower tool 23. In the embodiment shown, first actuator assembly 33 comprises a first pneumatic cylinder 35, which engages with an intermediate plate 37 that is firmly connected to two carrier elements 29 of support member 23*b* of lower tool 23. In the embodiment shown, an extendable end of first pneumatic cylinder 35 is attached to intermediate plate 37. In the embodiment shown, first actuator assembly 33 therefore acts directly upon lower tool 23. In certain embodiments, it would also be conceivable that further connecting elements are interposed between lower tool 23 and first pneumatic cylinder 35. A stationary part of first pneumatic cylinder 35 is attached to a connection support 39 which is attached to two oppositely disposed vertical rods 27. First actuator assembly 33 is therefore suspended at upper tool 21 by vertical rods 27.

Figure 5:
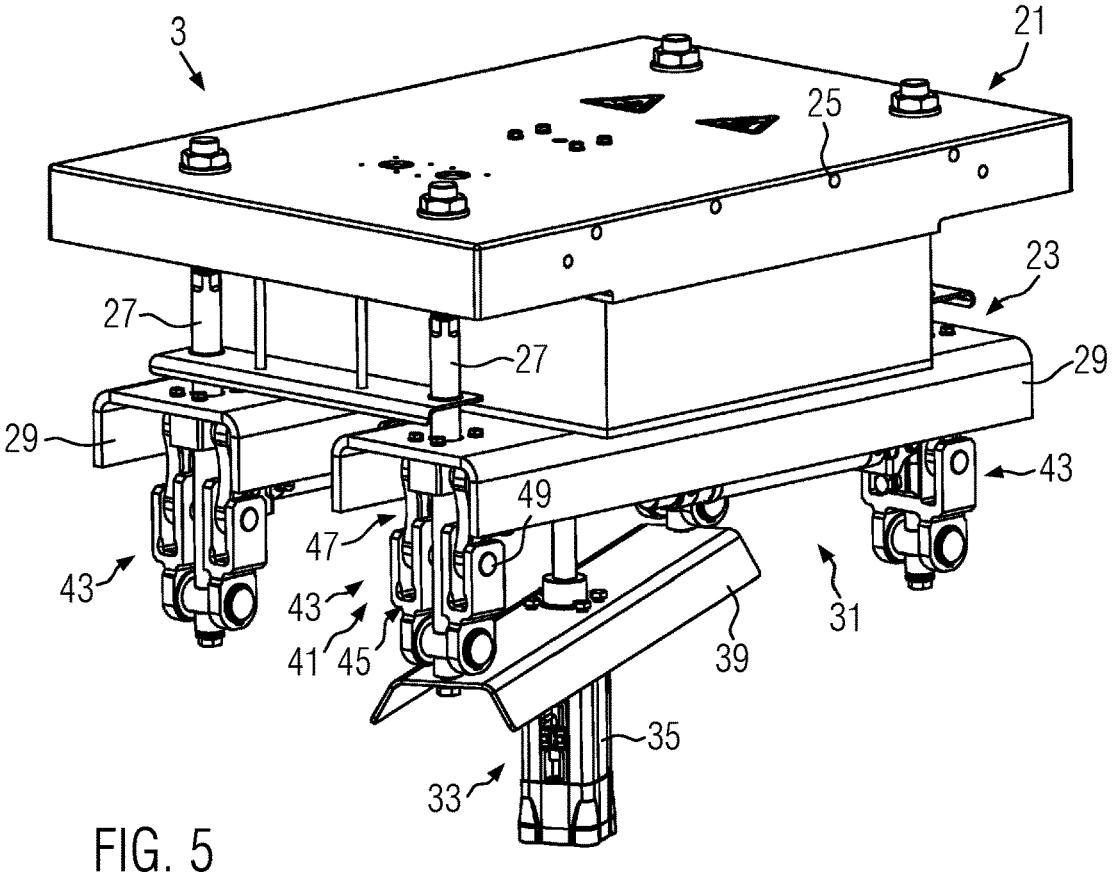
FIG. 5 shows a schematic perspective view of the work station in the closed state of the work station.
Figure 6:
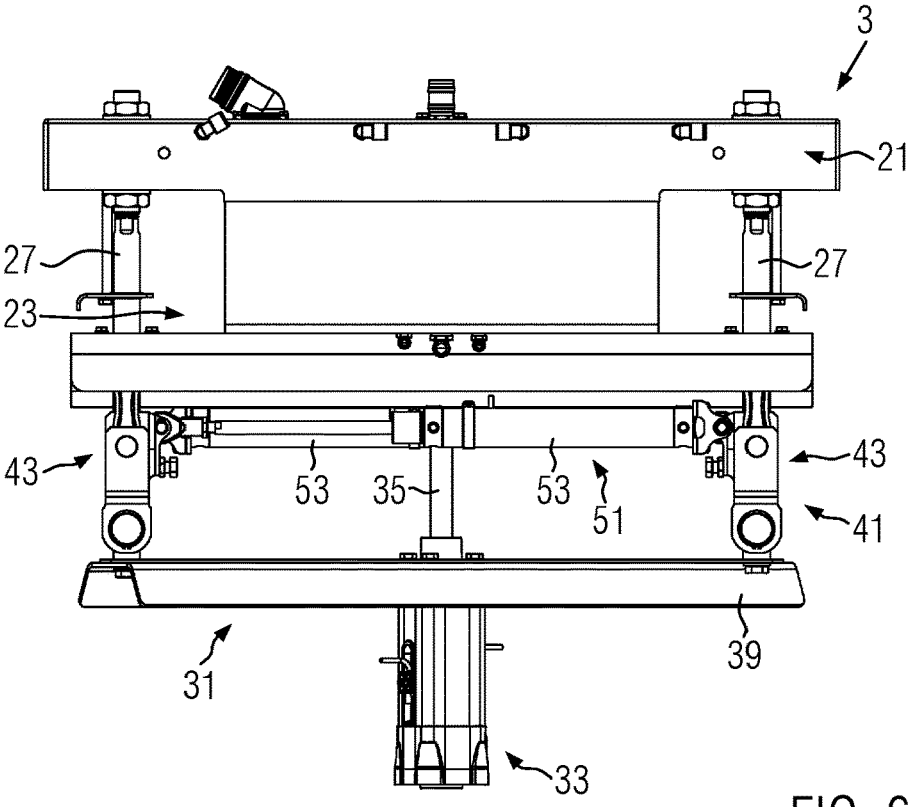
FIG. 6 shows a schematic side view of the work station in the closed state of the work station.

As can likely be seen best from FIGS. 5 and 6, which show work station 3 in a closed position, i.e., with lower tool 23 raised, lifting mechanism 31 also comprises a toggle lever mechanism 41. Toggle lever mechanism 41 comprises multiple toggle lever structures 43. Individual toggle lever structures 43 are configured similarly to one another in the embodiment shown. In the embodiment shown, toggle lever mechanism 41 comprises four toggle lever structures 43, each of which is arranged a one of vertical rods 27. Toggle lever structures 43 each comprise a first lever 45 and a second lever 47. First lever 45 is connected to associated rod 27 in a manner rotatable about a horizontal axis. Second lever 47 is connected to lower tool 23 in a manner rotatable about a horizontal axis. In addition, first lever 45 and second lever 47 are connected to one another at a connection point 49 and rotatable about a horizontal axis.

Lifting mechanism 31 also comprises a second actuator assembly 51 which comprises two second pneumatic cylinders 53 in the embodiment shown. Second pneumatic cylinders 53 each connect two oppositely disposed toggle lever structures 43. As can be seen from FIGS. 4 and 6, second pneumatic cylinders 53 are connected to associated toggle lever structures 43 in such a way that toggle lever structures 43 are erected when second pneumatic cylinders 53 are extended and a force for lifting lower tool 23 is thus generated. Retraction of the second pneumatic cylinder, i.e., shortening second pneumatic cylinder 53, on the other hand, may lead to toggle lever structures 43 folding together and lower tool 23 being lowered.

First actuator assembly 33 acts upon lower tool 23 while bypassing toggle lever mechanism 41, as can be seen from FIG. 3. The action of force by first actuator assembly 33 upon lower tool 23 is therefore not effected via toggle lever mechanism 41. A transmission ratio of toggle lever mechanism 41 is not relevant for the transmission of force by first actuator assembly 33 upon lower tool 23. Second actuator assembly 51 acts upon toggle lever mechanism 41. Power transmission for raising lower tool 23 by second actuator assembly 51 is effected in accordance with the transmission ratio of toggle lever mechanism 41.

Figure 4:
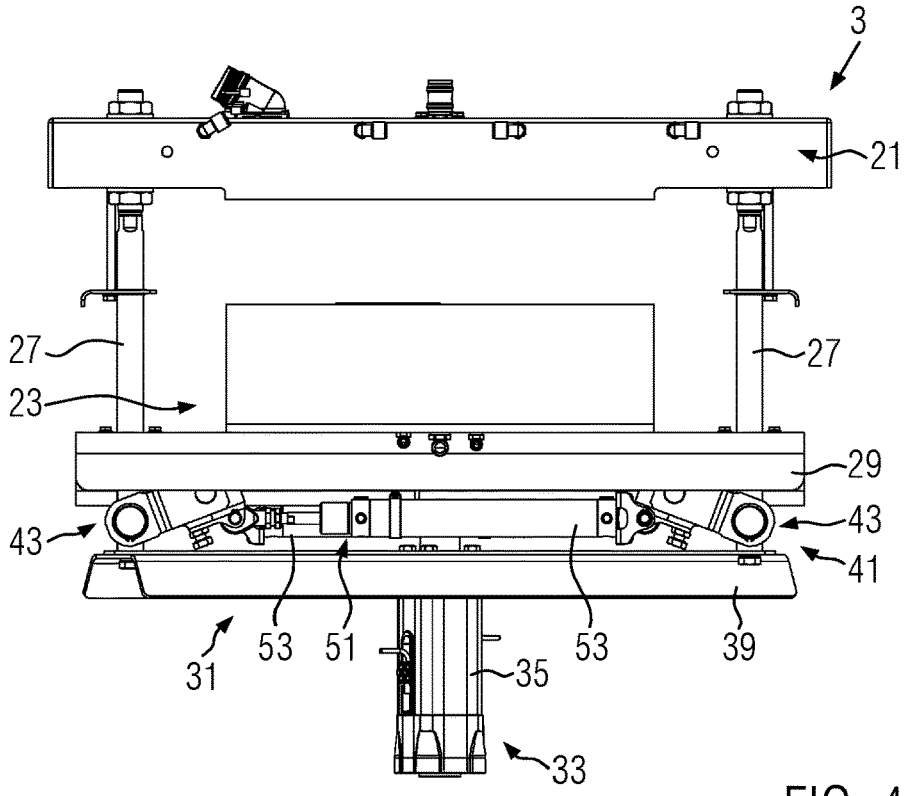
FIG. 4 shows a schematic side view of the work station in the open state of the work station.

If lower tool 23 is to be raised from the lowered position (open work station 3) shown in FIGS. 2, 3 and 4, then first actuator assembly 33 is first actuated to raise the lower tool 23. First pneumatic cylinder 35 is extended and raises lower tool 23. In this phase, second actuator assembly 51 is in a freewheeling mode. Second pneumatic cylinders 53 may therefore be extended or retracted essentially without resistance. When lower tool 23 is raised by first actuator assembly 33, toggle lever mechanism 41 is raised to a certain extent quasi as a positive side effect. By raising lower tool 23 by way of first actuator assembly 33, which acts upon lower tool 23 while bypassing toggle lever mechanism 41, toggle lever mechanism 41 is therefore put into a state in which there is an improved transmission ratio given when toggle lever mechanism 41 is actuated by second actuator assembly 51. Once lower tool 23 has been raised to a certain extent by first actuator assembly 33, then second actuator assembly 51 is activated and acts upon toggle lever mechanism 41 to further raise lower tool 23 or to press lower tool 23 against the upper tool 21. This is done specifically by extending second pneumatic cylinder 51 and a resulting transmission of force by toggle lever mechanism 41 upon lower tool 23. This procedure is particularly efficient because toggle lever mechanism 41 has already been taken to a work region with a good transmission ratio by first actuator assembly 33 prior to second actuator assembly 51 being activated First actuator assembly 33 may be dimensioned substantially such that it applies the force required for raising lower tool 23, i.e., may counteract at least the weight force of lower tool 23. The additional force for pressing lower tool 23 against upper tool 21 may be provided by second actuator assembly 51. Second pneumatic cylinders 53 of second actuator assembly 51 may be dimensioned to be relatively small due to the division of the force between first actuator assembly 33 and second actuator assembly 51 when lower tool 23 is pressed against upper tool 21 and due to the good transmission ratio in toggle lever mechanism 41.

Lower tool 23, first actuator assembly 33 and second actuator assembly 51 are supported by vertical rods 27. The stroke of lower tool 23 may be adjusted in a simple manner by adjusting vertical rods 27 on upper tool 21.

What is claimed is:

1. A work station for a packaging machine, the work station comprising:

an upper tool and a lower tool, where the lower tool is guided for a closing motion that is directed along a vertical direction towards the upper tool; and a lifting mechanism comprising a toggle lever mechanism connecting the lower tool to a support structure;

wherein the lifting mechanism comprises a first actuator assembly configured to apply a first force for raising the lower tool and a second actuator assembly configured to apply a second force for raising the lower tool; and wherein the first actuator assembly acts upon the lower tool while bypassing the toggle lever mechanism and the second actuator assembly acts upon the toggle lever mechanism.

2. The work station according to claim 1, wherein the first actuator assembly is configured to raise the lower tool by a first stroke and the second actuator assembly is configured to raise the lower tool by a second stroke, wherein the first stroke is larger than the second stroke.

3. The work station according to claim 2, wherein the second actuator assembly is configured to be activated to apply the second force after the lower tool has been raised by the first actuator assembly.

4. The word station according to claim 1, wherein the first actuator assembly and the second actuator assembly are configured to apply the first force and the second force simultaneously for a period of time.

5. The work station according to claim 1, wherein the first actuator assembly raising the lower tool leads to an adjustment of the toggle lever mechanism without active operation of the second actuator assembly.

6. The work station according to claim 1, wherein the first actuator assembly raising the lower tool leads to an extension of the toggle lever mechanism.

7. The work station according to claim 1, wherein the second actuator assembly is configured to provide a pressing force for pressing the lower tool against the upper tool.

8. The work station according to claim 1, wherein the toggle lever mechanism comprises multiple toggle lever structures, each of the multiple toggle level structures connecting the lower tool to the support structure, wherein the second actuator assembly acts upon the multiple toggle lever structures.

9. The work station according to claim 8, wherein the second actuator assembly comprises an element variable in length that acts simultaneously upon two oppositely disposed toggle lever structures.

10. The work station according to claim 8, wherein the second actuator assembly comprises a pneumatic cylinder that acts simultaneously upon two oppositely disposed toggle lever structures.

11. The work station according to claim 1, wherein the first actuator assembly and/or the second actuator assembly comprises an element variable in length.

12. The work station according to claim 1, wherein the lower tool is suspended on rods.

13. The work station according to claim 12, wherein the first and/or the second actuator assembly is suspended on the rods.

14. The work station according to claim 1, wherein the first actuator assembly and/or the second actuator assembly comprises a pneumatic cylinder.

15. The work station according to claim 1, wherein the second actuator assembly is spaced from and not connected to the first actuator assembly.

16. The work station according to claim 1, wherein the first actuator and the second actuator assembly each comprise a pneumatic cylinder, a spindle drive, or an electric linear drive.

17. The work station according to claim 1, wherein the first actuator assembly and the second actuator assembly each comprise an element variable in length.

18. The work station according to claim 1, wherein the first actuator assembly and the second actuator assembly each comprise a drive.

19. A method for operating a work station for a packaging machine, the method comprising:

raising a lower tool along a vertical direction towards an upper tool by applying a first force by way of a first actuator assembly which acts upon the lower tool while bypassing a toggle lever mechanism which connects the lower tool to a support structure;

applying a second force for pressing the lower tool against the upper tool by way of a second actuator assembly which acts upon the toggle lever assembly.

20. The method according to claim 19, wherein raising the lower tool by way of the first actuator assembly adjusts the toggle lever assembly.

21. The method according to claim 19, wherein the toggle lever assembly is first adjusted by raising the lower tool by way of the first actuator assembly to a work range with improved leverage and the second actuator assembly subsequently actively actuates the toggle lever assembly to further raise the lower tool and/or to press the lower tool against the upper tool.

22. The method according to claim 19, wherein the first force is also applied, during the application of the second force.

23. A work station for a packaging machine, the work station comprising:

an upper tool and a lower tool, the lower tool being guidable in a closing motion along a vertical direction towards the upper tool; and a lifter comprising a toggle lever connecting the lower tool to a support structure;

the lifter comprising a first actuator configured to apply a first force for raising the lower tool and a second actuator configured to apply a second force for raising the lower tool; and wherein the first actuator is actable upon the lower tool while bypassing the toggle lever and the second actuator is actable upon the toggle lever.

* * * * *